US005806252A

United States Patent [19]

Scuero

[11] Patent Number: 5,806,252

[45] Date of Patent: Sep. 15, 1998

[54] WATERPROOFING SYSTEM FOR HYDRAULIC STRUCTURES WITH RIGID SHEETS IN SYNTHETIC MATERIAL

[75] Inventor: Alberto Scuero, Lugano, Switzerland

[73] Assignee: Sibelon S.p.A., Arona, Italy

[21] Appl. No.: 754,621

[22] Filed: Nov. 21, 1996

[30] Foreign Application Priority Data

Nov. 24, 1995 [IT] Italy ..... MI95 A 002458

[51] Int. Cl.[6] ..... E02D 19/00

[52] U.S. Cl. ..... 52/169.7; 52/741.4; 52/169.11; 52/169.14; 52/582.2; 405/268; 405/270

[58] Field of Search ..... 52/169.7, 741.4, 52/169.11, 169.14, 582.2, 581; 405/270, 268

[56] References Cited

U.S. PATENT DOCUMENTS

| | | | |
|---|---|---|---|
| 2,308,294 | 1/1943 | McCorkle et al. | 405/270 |
| 3,841,041 | 10/1974 | Friedland et al. | 52/169.7 |
| 3,854,292 | 12/1974 | Nienstadt | 405/270 |
| 3,949,113 | 4/1976 | Draper et al. | 405/270 X |
| 4,207,017 | 6/1980 | Jarrell | 405/270 |
| 4,678,375 | 7/1987 | Gogle et al. | 405/270 |
| 5,160,221 | 11/1992 | Rohe et al. | 405/270 |

FOREIGN PATENT DOCUMENTS

| | | | |
|---|---|---|---|
| 1289952 | 2/1987 | U.S.S.R. | 405/270 |

*Primary Examiner*—Creighton Smith
*Assistant Examiner*—W. Glen Edwards
*Attorney, Agent, or Firm*—Young & Thompson

[57] ABSTRACT

A waterproofing system and method for hydraulic structures which includes rigid sheets of synthetic material connected with flexible hinges made of sheets of synthetic material. Mechanical anchoring hold the rigid sheets in place.

9 Claims, 3 Drawing Sheets

WATERPROOFING SYSTEM FOR HYDRAULIC STRUCTURES WITH RIGID SHEETS IN SYNTHETIC MATERIAL

BACKGROUND OF THE INVENTION

The present invention relates to the waterproofing of hydraulic structures by sheets of synthetic materials, and more precisely it refers to waterproofing of hydraulic structures by rigid and/or semi-rigid sheets of any synthetic material, for example PVC, polypropylene, polyethylene or other, either of flat or shaped type, suitable for maintaining their stiffness for the envisaged applications.

For the purposes of the present description, by the wording "sheet of rigid, semi-rigid or non-extendable material" reference is made to any sheet or plate of synthetic material, having a suitable formulation and a thickness of between a few millimeters and tens of millimeters or greater, so that the space between two points of the sheet is be substantially unchanged when said points are stressed by external forces; consequently said sheet or plate has a substantial indeformability and "self-supporting" properties, after being applied to the surface to be waterproofed, allowing for suitable spot anchoring at separated points.

As well known, the aging of hydraulic structures, such as reservoirs, canals, dams, sewage and the like, involves some problems due to water losses, which, soaking the surrounding ground, causes variations of the humidity content, thus affecting the ground strength. Said water losses, if not suitably limited and controlled, over time, may cause landslides which may also involve a risk for the stability of the hydraulic structure itself. The economic loss in relation to water losses should also be considered.

Therefore suitable maintenance and waterproofing of the hydraulic structures is very important both for safety and for economic management purposes.

So far, several solutions have been proposed to reduce or eliminate water losses, providing for simple localized repairs of the damaged structures, for example by suitable mortars or other concrete material, resin based paints, bituminous or synthetic membranes adhered to the surface to be waterproofed, or sometimes reconstructing a new surface which will come in contact with the water to be contained.

EP-A-0 459 015 proposes other solutions which provide for the use of flexible sheets of synthetic material, more simply known as geomembranes, for example based on PVC, PP, PE and PDM. According to said proposal the sheets are mechanically fastened to the back surface to be waterproofed, by metal profiles and/or mechanical fastening means, thus providing for an air chamber between the impermeable sheathing and the back surface, in such a way to collect and discharge the seepage waters on the back of the plastic sheathing, producing at the same time a dehydration effect of the masonry.

This known use of flexible material for sheathing has proved to be of particularly efficiency where the water inside the basin, reservoir or the canal is not moving or is flowing at very low speeds, in such a way not to cause substantial tensile stresses on the sheathing, which however should be firmly anchored to the back surface by a substantial set of mechanical anchoring means, the sheathing being made watertight by simply pressing the overlapped edges of the adjacent sheets.

Even if the use of impermeable membranes in flexible material has proved to be a valid solution for various applications, besides being cost-saving with respect to other conventional waterproofing systems, however, remarkable problems have been involved when flexible sheets have been used for waterproofing hydraulic structures in the presence of whirling waters, flowing at high speeds, in particular in the areas where strong turbulence occurs.

By way of example, reference can be made to covered or uncovered hydroelectric canals, pressurized hydraulic tunnels or areas of any hydraulic structure subjected to the inflow and outflow of strong current of water, such as weirs and the like.

In all these cases the dynamic effect of the stream, or the water turbulence, may damage a flexible geomembrane, tearing or stripping the same from its fastening points; therefore the flowing water could seep under the sheathing till totally damaging the same, or damaging the hydraulic structure itself, or the hydraulic apparatus connected to the same.

Such situations become more critical when the impermeable sheathing is fastened to a support which does not allow the use of an adequate number of fastening points; furthermore a structural inadequacy of the surface of the hydraulic structure requires long and expensive repairing works in order to provide for anchoring forces compatible with the mechanical features of the same geomembrane. Sometimes, the extension of the preliminary works on the supporting surfaces for the impermeable sheathing, are such to rend the geomembrane solutions expensive and not advantageous.

Therefore, the need still exist for impermeable sheathings of hydraulic structures which, besides maintaining all the advantages of the well known solutions, allow to effect the laying down and the anchoring of the same sheathings in an extremely rapid and cost-saving way, by using a relatively reduced number of anchoring points; a high reliability degree in the management of the structure is at the same time required, especially in the case of localized damages of the sheathing, allowing possible defects to occur on the sheathing, within acceptable safety and economic limits, during use.

Therefore, the general object of the present invention is to provide a system for the waterproofing of hydraulic structures by sheets of synthetic material, which are resistant to high mechanical stresses caused by the turbulence of flowing waters, by using an extremely reduced number of anchoring points, such as to allow for the laying down of impermeable sheathings by extremely simple modes, directed to assure a cost-saving and reliable waterproofing.

According to the invention, an impermeable sheathing is provided by means of sheets of rigid or semi-rigid synthetic material, either in the form of flat or shaped plates, which are laid down and anchored on the surface of the hydraulic structure to be protected by mechanical anchoring means in a limited number of predetermined points, suitable arranged to allow for a firm and safe anchoring of the same sheets.

The stiffness of the plates of synthetic material which constitute the impermeable sheathing, allows for remarkably increasing the anchoring force to be applied to the same plates; furthermore fastening of the plates to a back surface to be protected, usually in concrete material or in masonry, may be performed directly or by the disposition of a geonet or of a intermediate layer in a draining material for the pressurized waters which possibly may seep between the impermeable sheathing and the back surface of the protected hydraulic structure.

The greater force exerted at each single fastening point, together with the self-supporting of the single rigid or semi-rigid plates of synthetic material, allow for the distribution of the same anchoring force on the whole surface of the plate; a limited number of the anchoring points is therefore required. This solution, in case the back surface to be waterproofed and to which anchoring the sheathing has a limited mechanical strength, allows for a considerable reduction of the extension of the surface area of the hydraulic structure which will be preset or prepared to make it compatible with the desired fastening force.

Therefore, by considering a same surface area of the impermeable sheathing, the proposed solution to use flat or shaped rigid plates in synthetic material, compared with the conventional techniques, in particular with the use of flexible synthetic sheets, allows for a fewer number of fastening points and consequently a great save of costs.

Also the roughness degree of the surfaces on which the sheathing is applied is less critical and it could be greater when employing rigid plates, with respect to the use of flexible sheets or membranes according to the conventional techniques.

In the case of canals and tunnels, the plates in synthetic material may be applied on the side walls and the bottom surface, by watertight connection the same plates in any suitable way. For example longitudinal and/or cross welding, achievable for example by hot air thermal welding and cold chemical welding systems may be used, or watertight connection of the plates may be made by means of bands in rigid or flexible synthetic material; in this later case said bands define a suitable flexible hinge between adjacent plates, which allows for welding of plates and for the preparation of the same sheathing directly in the job site, or during their laying down.

The limited overall dimensions of the flat plates and the relatively reduced weight, allow also for their easy transport and assembly even in difficulty reachable areas, either in the job site or along the hydraulic structure to be waterproofed.

The fastening of the plates of synthetic material, of rigid or semi-rigid type, could be carried out by any suitable way; for example anchoring studs of any type, or rigid profiles of synthetic or metal material, always fastened by studs when a better distribution of the anchoring force is required. Preferably the anchoring studs or profiles are provided along the edges of the impermeable sheathing, by positioning the same above the maximum level that can be attained by the water. In some cases it is also possible to envisage the application of the anchoring means at the bottom surface, or the employment of a suitable ballast, as hereinafter explained. The watertight connection among the various plates, as already explained, is preferably obtained by means of hot welding systems, for example hot air thermal welding; cold welding should also be considered for example by THF or other chemical welding techniques, or by mechanical connections partially overlapping the edges of adjacent plates, or by a combination of the previous systems.

The advantages and the objects obtained with the present invention may be summarized as follows:

- greater anchoring force of the plates of rigid or semi-rigid synthetic material;
- possible drainage of the seeping waters;
- minimum preparation of the support surface area to be waterproofed;
- minimum number of the anchoring points, preferably localized outside the areas lapped on by the water;
- easy transport and rapid assembly of the plates constituting the impermeable sheathing;
- possibility of connecting the various rigid plates by flexible covering bands, which assure for a continuous waterproofing and the possibility of hinge turning of the same plates already welded to the same bands, for easy transport and laying down purposes;
- high mechanical strength of the impermeable sheathing, as well as withstanding attacks by external agents including vandalism; and
- lastly, high strength to the dynamic action of the waters with strong turbulence flow.

Summing up, according to the invention, an impermeable sheathing system has been provided of self-supporting type, not at all conditioned by the state of the support and the resting surface of the hydraulic structure which is to be protected.

These and other objects and advantages of the present inventions are obtainable with a system for carrying out waterproofing of hydraulic structures by sheets or plates in rigid or semi-rigid synthetic material, according to claim 1.

BRIEF DESCRIPTION OF THE DRAWINGS

As a not limiting example, the invention will be better hereinafter illustrated with reference to the attached drawings, relating to the waterproofing of a canal, wherein.

DESCRIPTION OF THE INVENTION

With reference now to figures from 1 to 4, we will describe a first embodiment and two different anchoring systems of the impermeable sheathing.

Figure 1:
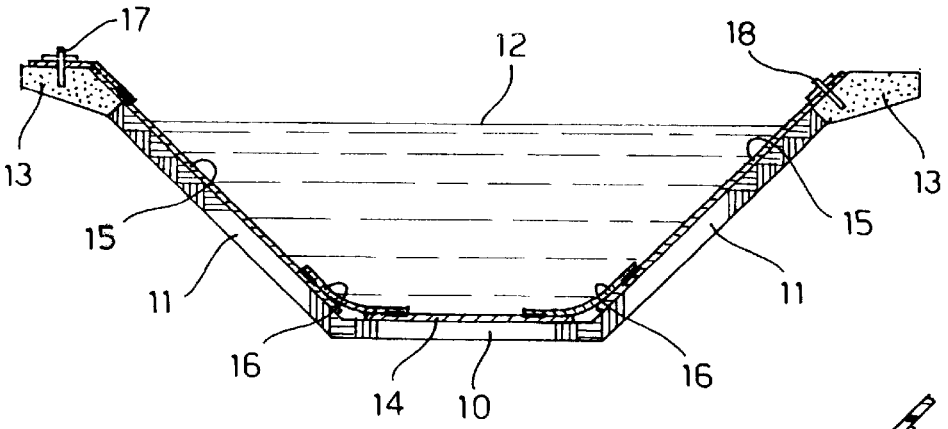
FIG. 1 is a sectional view of a canal provided with an impermeable sheathing according to a first embodiment of the invention.

In FIG. 1 the cross sectional view of a generic water conveying canal is shown, comprising a bottom surface 10 and side flat walls 11 sloping towards the outside. Reference 12 in the same figure indicates the level of the water in the canal.

The side walls 11 of the canal, in the example shown, may end with the upper edge in correspondence to a horizontal concrete beam 13, which longitudinally runs along the canal at ground level.

From the same figure, it results that the inner surface of the canal is protected by a suitable impermeable sheathing constituted by rigid plates of synthetic material, mechanically anchored in predetermined points to the same side walls of the canal, and or to the beams 13, over the level of the water 12 as hereinafter explained. More particularly, in the case of FIG. 1, the impermeable sheathing which longitudinally extends along the canal, comprises plates 14 simply laying on the bottom surface 10 of the canal, and side plates 15 laying against the side walls 11; the side plates 15 are connected to the bottom plates 14 by covering bands 16 which extend longitudinally to the canal; the bands 16 could be suitably shaped and made of the same material as the rigid plates 14, or may be in synthetic flexible material, to form a kind of flexible hinge, allowing for the self-turning of the plates 10 and 11 during the preparation and laying down steps of the impermeable sheathing, as hereinafter explained with reference to FIG. 5.

The mechanical watertight connection of the bands 16 to the opposite edges of two adjacent plates, as previously indicated, may be performed by any suitable means; for example use may be made of thermal welding, carried out in advance in the factory or directly on the job site, as well as before applying the plates to the internal surface of the canal to be protected.

More precisely, the working mode is the following:

locating and preparing the anchoring points for the plates, for example at the top edge of the side walls of the canal, more generally in localized points of the hydraulic structure to be protected;

preparing said anchoring points to make them suitable for the insertion of the anchoring means;

a predetermined length of the sheathing is erected by fastening the plates to the selected anchoring points sufficiently spaced apart, as schematically shown with reference 17 or 18 in FIG. 1.

The previous steps are repeated more times, the till covering the selected part of the canal or the entire canal length, or the surface of the hydraulic structure to be protected, providing for the required cross watertights between subsequent sheathing portions of the plates, for example by overlapping and welding the edges of the same plates; at the beginning and at the end of the sheathing, the necessary cross watertight connections will be obviously executed.

Figure 2:
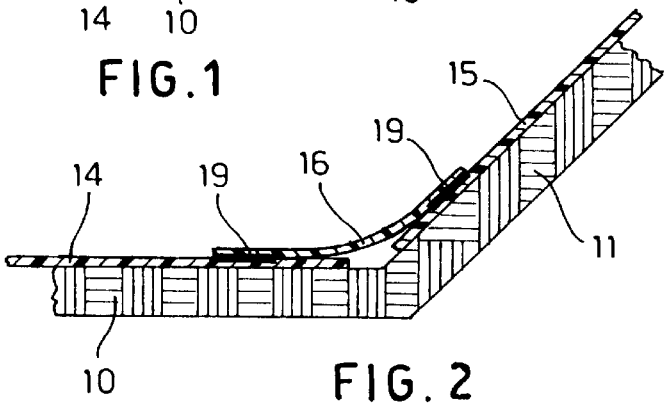
FIG. 2 is an enlarged view of FIG. 1, in correspondence to the connecting point between the bottom and a side wall of the canal.

FIG. 2 shows, as an example, an enlarged detailed view of the covering band 16 between the facing edges of adjacent plates 14 and 15, where reference 19 indicates the welding lines.

Figure 3:
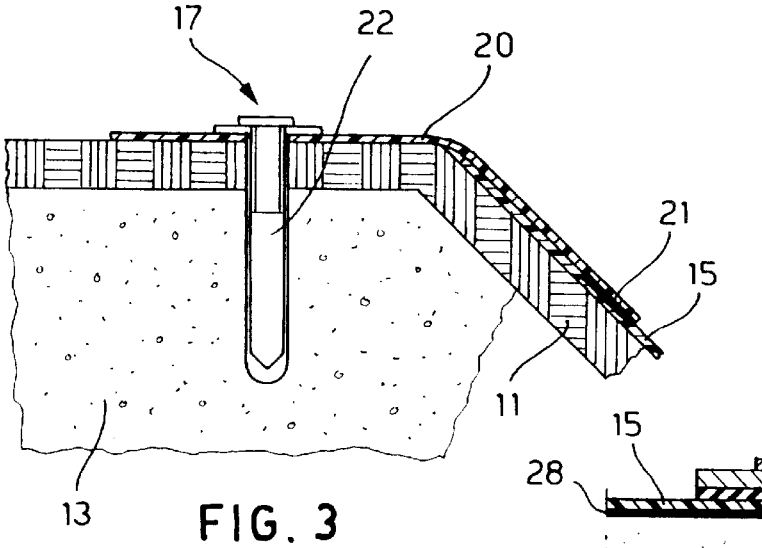
FIG. 3 is an enlarged view of the anchoring point at the left top end of FIG. 1.

FIG. 3 shows an enlarged detailed view of an anchoring point 17 according to a first embodiment of the invention. As shown, in this case the anchoring 17 is effected to the side beam 13, on the horizontal ground line, by using an angular section 20 in metal or in the same material of the plate 15, suitably bent by simple deformation. From said FIG. 3 it can be seen that one wing of the angular element 20 is partially overlapped to the longitudinal edge of the plates 15 and welded along the welding line 21; the other wing of the angular element 20 is leaned against the horizontal surface of the beam 13 fastening it by stud bolts, screws and washers 22, threaded into corresponding holes already pre-formed in longitudinally spaced apart positions in the wing of the angular element, forcing them in the concrete of the beam 13.

Figure 4:
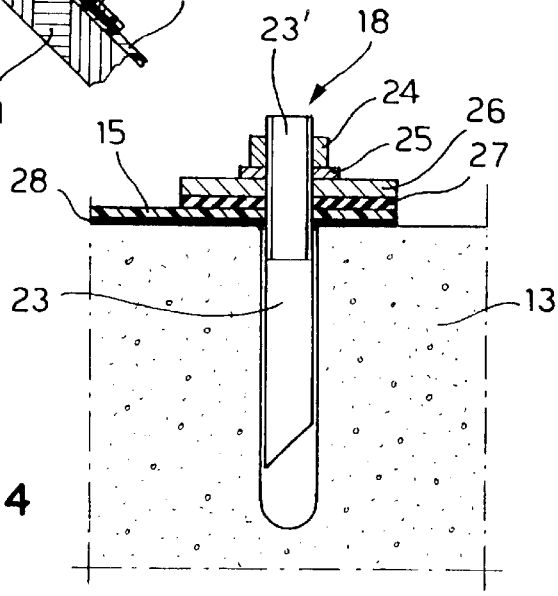
FIG. 4 is an enlarged view of the anchoring point at the right top end of FIG. 1.

Another alternative is shown in the enlarged view of FIG. 4, corresponding to the anchoring point 18 of FIG. 1; in this case the anchoring stud 23 presents a protruding threaded portion 23' on which a nut 24 is screwed on, which, by a washer 25, a strap 26 and a rubber gasket 27 presses the plate 15 against the sloping part of the beam 13, or against the side wall of the canal. In the same figure, reference 28 indicates a layer in a suitable resin material for leveling and preparing the anchoring surface.

Figure 5:
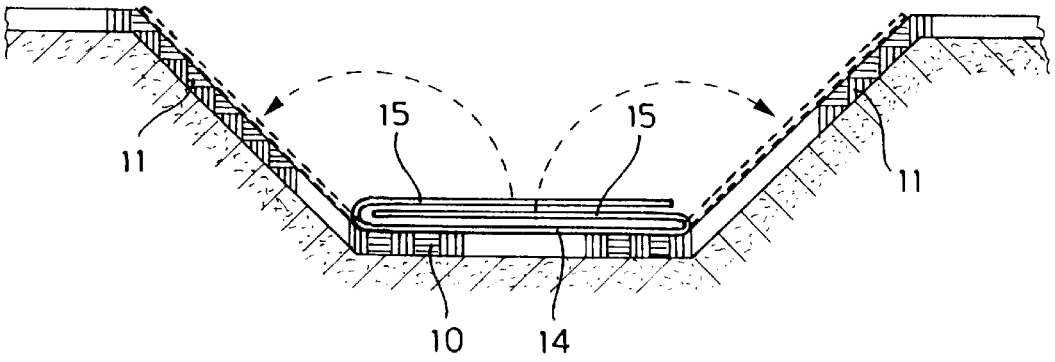
FIG. 5 schematically shows the application and laying down procedure of the impermeable sheathing of FIG. 1.

FIG. 5 of the drawings shows the laying down scheme for a part of an impermeable sheathing, according to the solution of FIG. 1. The already welded and inside-turned plates 14 and 15, as shown with a continuous line in FIG. 5, are firstly laid down with care on the bottom 10 of the canal. Successively the upper plate 15 is raised, making the same to rotate against the left side wall, then the other plate 15 is made rotate against the right side wall; lastly the various anchoring steps in the points indicated by references 17 or 18 are performed.

This solution, which employ flexible hinge means for the watertight connection between the adjacent plates, is particularly advantageous in all the applications involving difficulties in transporting as well as in anchoring the sheathing to the surface to be waterproofed.

Figure 6:
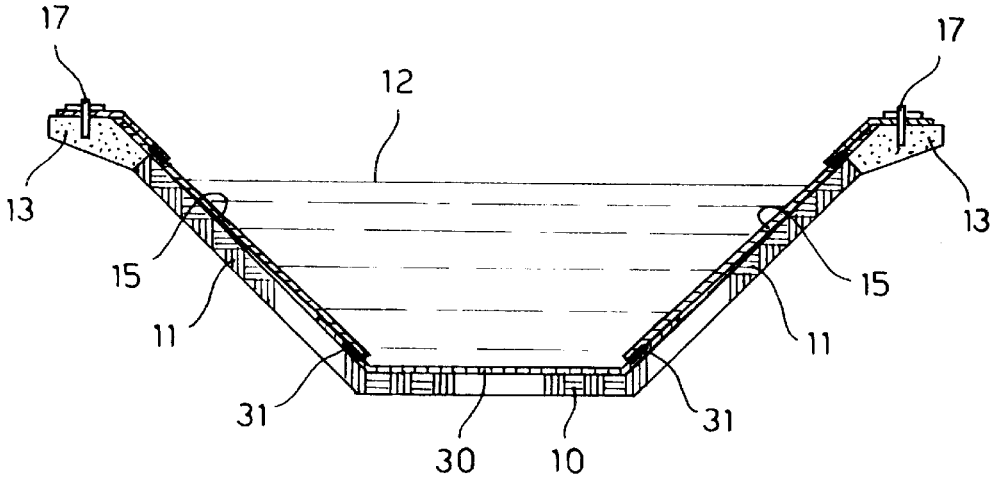
FIG. 6 shows a second embodiment of the waterproofing system according to the invention.
Figure 7:
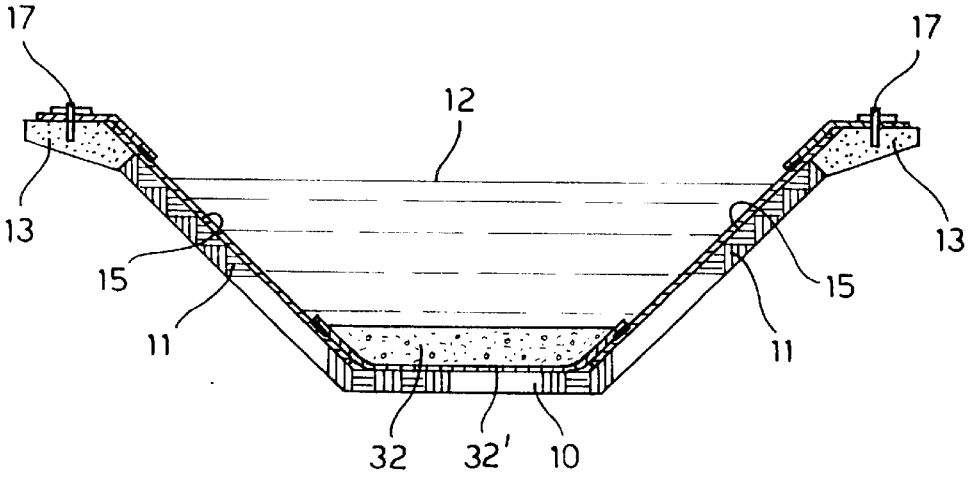
FIG. 7 shows a third embodiment of the waterproofing system according to the invention.
Figure 8:
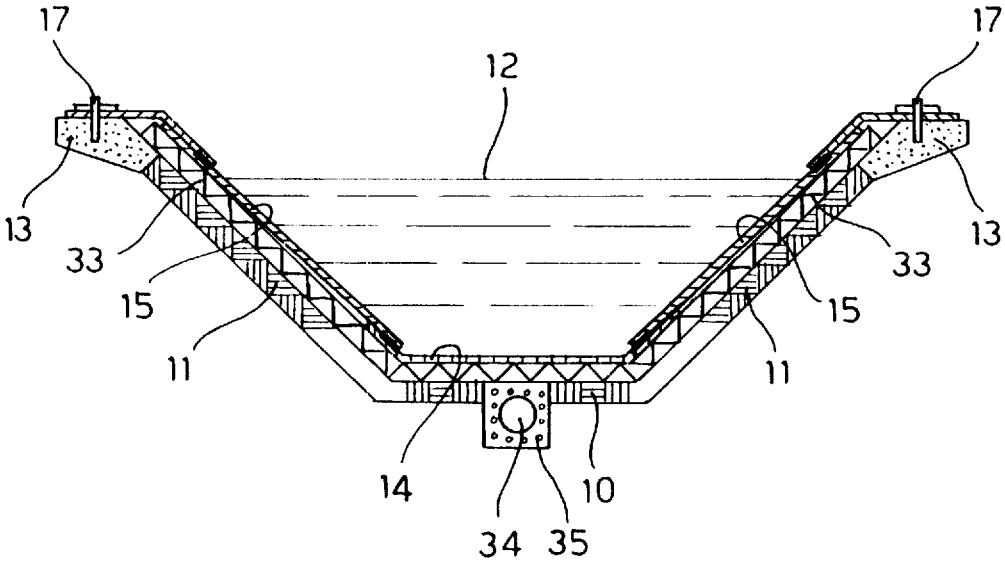
FIG. 8 shows further characteristics of the waterproofing system by rigid plates, according to the invention.

FIGS. 6, 7 and 8 show further possible embodi-ments in the carrying out of waterproofing of hydraulic structures by means of plates of rigid sheets of synthetic material, as previously mentioned.

The example of FIG. 6 differs from the previous one of FIG. 1, as the bottom flat plate 14 and the flexible bands 16 have been substituted by a shaped plate 30, of the same material as the plates 15; the side edges of the plate 30 have been suitably bent for a predetermined width, in order to partially overlap the bottom edges of the side plates. In this case, the watertight and the mechanical connections are achieved by welding 31 carried out directly between the overlapped edges of the plates. For all the remaining, the example of FIG. 6 is quite similar to the one of FIG. 1 and therefore the same reference numbers have been used for similar or equivalent parts.

The example of FIG. 7 relates to a further embodiment which differs from the case of FIG. 6 in that a flexible sheet 32' of synthetic material, welded to the edges of the rigid plates 15 as in the preceding case, is now used in place of the bottom rigid plate 30, having shaped or up-turned at the edges.

To compensate a possible insufficiency in the mechanical strength of the support surface in the anchoring points of the sheathing, and to greatly oppose the force exerted by the water which should tend to remove the fastening members, it is possible to apply on the bottom side a ballast 32 obtained by a cast of concrete or by a layer of shotcrete. In the case of canals or tunnels, it is possible also to apply said ballast in vertical or on slopped planes of the side walls. Said additional works, besides providing a suitable fastening at the impermeable sheets to the back support surface, in some cases perform a mechanical protection against the external weather or accidental agents, such as for example vandal actions or impacts due to external bodies.

The embodiment in FIG. 7 may be useful for some applications maintaining the advantages of the solution of FIG. 1; this solution allows for the turning of the plates, thanks to the hinge function of the flexible bottom sheet 31'. In this case also, all the remaining parts of the impermeable sheathing are substantially unchanged, therefore the same reference numbers have been used for corresponding parts.

FIG. 8 shows a further embodiment according to the example of FIG. 6, wherein a drainage layer 33 for the seeping water has been provided between the rigid sheathing plates 14, 15 and/or 30 and the walls 11 and bottom 10 of the canal, said layer being for example a net structure for collecting possible waters which seep in the bottom chamber between the impermeable sheathing and the canal walls, for example for accidental ruptures of the sheathing itself, and from there convoyed towards the discharge conduit 34; the conduit 34 may be constituted by a perforated pipe enveloped by a gravel, along a trench 35 at the bottom of the water canal. Also in this case, all the remaining parts, similar or identical to those of the previous cases, have been indicated with the same reference numbers.

Figure 9:
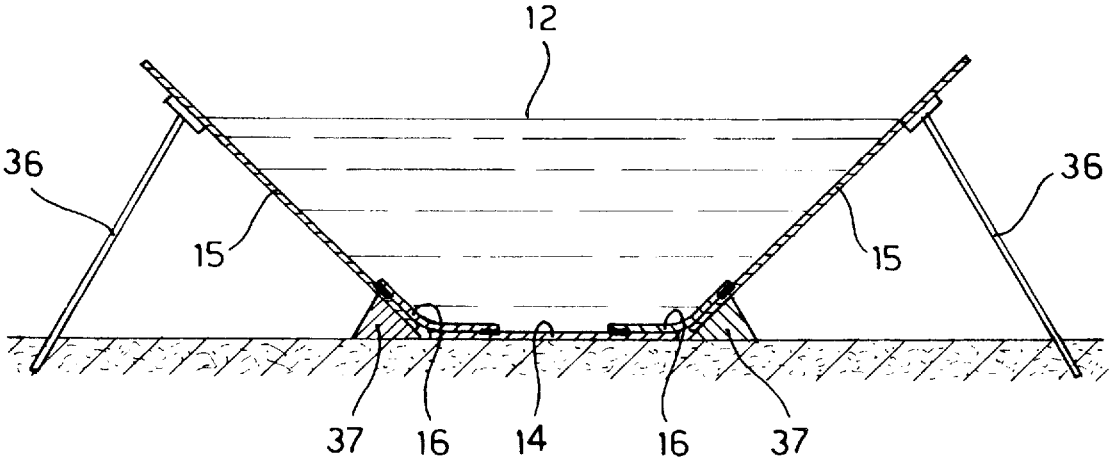
FIG. 9 shows lastly the possibility of performing a water conveying canal, by simply using the same rigid sheet impermeable sheathing, according to the invention.

FIG. 9 of the drawings shows a further possible use of the impermeable sheathing by rigid plates of the example of FIG. 1, which can be advantageously used to temporarily carry out in place, limited parts of a water conveying canal, above the ground level. This can be obtained thanks to the rigid nature and the self-supporting features of the same waterproofing rigid plates, providing, in this case, for supporting the side plates 11 by suitable rods 36 and possible bottom blocks 37 directly resting on the ground. In this case also, the possible use of flexible hinges 13 for connecting the plates 10 and 11, makes easy the transport, the assembling and the possible future removal of the water conveying canal thus formed.

From what above said and shown, it is now clear that it has been provided a systems for waterproofing hydraulic structures with rigid or semi-rigid sheets in synthetic material, which presents a great versatility and efficiency in use as the limited overall dimensions of the flat plates and their relatively reduced weight, make easy to transport and assembling them also in areas of difficult access, and therefore the delivery of the material in the job site of the hydraulic structures to be repeared and protected, may be easily effected along the canal or tunnel, or along the same hydraulic structure to be waterproofed.

Moreover, the installation of the sheathing plates may be carried out either in a dry mode, that is without water in the hydraulic structure, or directly operating underwater with suitable apparatus and with a staff suitably equipped, by using appropriate watertight fastening systems.

What is claimed is:

1. A foldable covering for water-proofing a bottom and sides of a hydraulic structure, the covering comprising:

a rigid or semi-rigid bottom panel of synthetic material;

two rigid or semi-rigid side panels each of a synthetic material; and hinges for flexibly joining said bottom panel to respective ones of said side panels, each of said hinges comprising a sheet of foldable synthetic material sealably affixed to said bottom panel and to one of said side panels along adjacent edges thereof, each of said hinges having a length so that said side panels are hingedly movable towards each other, with one of said side panels lying directly on said bottom panel and the other of said side panels lying directly on said one side panel, and so that the folded said side panels are hingedly movable away from each other onto sides of the hydraulic structure when said bottom panel is on the bottom of the hydraulic structure.

2. The covering of claim 1, wherein said panels are flat.

3. The covering of claim 1 wherein said panels are pre-formed.

4. The covering of claim 1, wherein said hinges are affixed to said bottom panel and to said side panels by welding.

5. The covering of claim 1, wherein said rigid or semi-rigid synthetic material comprises a material selected from the group consisting of PVC, polypropylene, and polyethylene.

6. The covering of claim 1, wherein said panels are rigid and further comprising supports for holding said side panels at an angle to said bottom panel to form a water conduit.

7. The covering of claim 1, further comprising fastening means for attaching said side panels to upper portions of the sides of the hydraulic structure.

8. A method of waterproofing a bottom and sides of a hydraulic structure, the method comprising the steps of:

forming a waterproofing structure ready for insertion into the hydraulic structure by, sealably affixing a foldable synthetic material hinge to a rigid or semi-rigid synthetic material bottom panel and to a rigid or semi-rigid synthetic material side panel along adjacent edges thereof, sealably affixing a second foldable synthetic material hinge to the bottom panel and to a second rigid or semi-rigid synthetic material side panel along adjacent edges thereof, and folding the two side panels towards each other so that one of the side panels is on the bottom panel and the other of side panels is on the one side panel;

inserting the folded waterproofing structure into the hydraulic structure with the bottom panel on a bottom of the hydraulic structure;

unfolding the side panels away from each other onto sides of the hydraulic structure; and anchoring the side panels into position.

9. The method of claim 8, wherein said hinges are affixed to said bottom panel and to said side panels by welding.

* * * * *